US005690340A

United States Patent [19]

Musleh

[11] Patent Number: 5,690,340

[45] Date of Patent: Nov. 25, 1997

[54] METHOD AND APPARATUS FOR A SECRET IDENTITY ADVENTURE GAME

[76] Inventor: Susan Musleh, 7551 Farm View Cir. E., Indianapolis, Ind. 46256

[21] Appl. No.: 540,194

[22] Filed: Oct. 6, 1995

[51] Int. Cl.[6] ..... A63F 9/00

[52] U.S. Cl. ..... 273/459

[58] Field of Search ..... 273/459, 460; 206/223, 579, 232, 387

[56] References Cited

U.S. PATENT DOCUMENTS

| | | | |
|---|---|---|---|
| 4,124,943 | 11/1978 | Mitchell et al. | 35/8 |
| 4,433,780 | 2/1984 | Ellis | 206/232 |
| 4,828,105 | 5/1989 | Silengo et al. | 206/232 |
| 5,022,522 | 6/1991 | Kennedy | 206/387 |
| 5,066,016 | 11/1991 | O'Neill | 273/249 |
| 5,083,791 | 1/1992 | Coombes, Jr. | 273/237 |
| 5,236,200 | 8/1993 | McGregor et al. | 273/459 |

*Primary Examiner*—Paul E. Shapiro
*Attorney, Agent, or Firm*—Woodard, Emhardt, Naughton, Moriarty & McNett

[57] ABSTRACT

An adventure game including a first themed communication element having audible or visible indicia introducing an intermediary, identifying the intermediary as an author of said first themed communication element, identifying that the first themed communication element is directed to a target, and explaining that a person is interested in the target; a second themed communication element having audible or visible indicia identifying the intermediary as an author of the second themed communication element, identifying the target as the recipient of the second element, and expressing additional information concerning at least one of the person, the intent of the person, and what is expected of the target; a third communication element directed to the target and including audible or visible indicia inviting the target to be at a certain place at a certain time; an instruction guide including audible or visible indicia instructing the person to send said first themed communication element to the target first, to send the second themed communication element to the target after the first themed communication element and to send the third communication element to the target after the second themed communication element; and wherein each of the communication elements is a part of pre-defined scenario having a particular theme with at least the first and second communication elements having additional audible or visible indicia consistent with the theme.

29 Claims, 2 Drawing Sheets

METHOD AND APPARATUS FOR A SECRET IDENTITY ADVENTURE GAME

COPYRIGHT AUTHORIZATION

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever. The copyright notice as appearing herein applies to the entire disclosure including the description of the preferred embodiment and the drawings.

FIELD OF THE INVENTION

The present invention relates to games, and more particularly, to a secret identity adventure game between two or more people where at least one person is the target who is led through a pre-defined scenario by another person.

BACKGROUND OF THE INVENTION

Dating. Some excel at it. But, many bemoan it. From the first date through the so called "comfortable" period, and even into the well settled relationship, dating has been a common subject for complaint, confusion and frustration. For many, there is never an easy way to first approach that person who has caught our attention. Whether at a picnic, at a party, at church, in a bar or elsewhere, as soon as we spot that person with the special look or laugh, we fantasize about walking right up to him or her and speaking with James Bond confidence and charm. Reality often steps in, however, and cuts us off at the knees as our IQ is cut in half and our mouths turn dry as desert sand before we can even get out the first "hello". This only happens, of course, when we try to approach that really amazing person. Of course, not every first meeting is difficult. There are times when that first meeting is as natural as breathing. Introduction by a mutual friend, working together on a project in business or school, or being seated together in traffic court are but a few examples. But, for those times when there is no easy way to meet that special person, there is a need for something different to break the ice and make that first meeting an event to be enjoyed rather than feared.

Relationships are often not only difficult to start, but they can also be difficult to maintain. In the established relationship, after each person has grown familiar with the other's personality, behavior and likes and dislikes, they may discover that the relationship has gone flat—that the romance has gone. Internal motivation may be lacking, and attempts arising from within the relationship to liven it up may often fail because they are, for the most part, the same ideas from the same people. What is needed is, for stagnant relationships as well as healthy relationships, is something to allow the couple to rediscover itself—to allow each person to see the other apart from the familiar routine and rekindle old emotions and feelings.

SUMMARY OF THE INVENTION

Generally speaking there is provided an adventure game wherein a person, the sender, chooses another person, the target, and sends a series of themed and progressive correspondence elements to the target that set up an ultimate rendezvous between the target and the sender, the sender's identity preferably having been kept secret until the rendezvous.

An adventure game in one embodiment includes a first themed communication element having audible or visible indicia introducing an intermediary, identifying the intermediary as an author of said first themed communication element, identifying that the first themed communication element is directed to a target, and explaining that a person is interested in the target; a second themed communication element having audible or visible indicia identifying the intermediary as an author of the second themed communication element, identifying the target as the recipient of the second element, and expressing additional information concerning at least one of the person, the intent of the person, and what is expected of the target; a third communication element directed to the target and including audible or visible indicia inviting the target to be at a certain place at a certain time; an instruction guide including audible or visible indicia instructing the person to send said first themed communication element to the target first, to send the second themed communication element to the target after the first themed communication element and to send the third communication element to the target after the second themed communication element; and wherein each of the communication elements is a part of a pre-defined scenario having a particular theme with at least the first and second communication elements having additional audible or visible indicia consistent with the theme.

Other embodiments include additional communication elements such as one or more clues to be sent to the target to both tantalize the target and assist the target in guessing the identity of the sender before the rendezvous.

Underlying all the communication elements is the continuity of a pre-defined scenario that is reflected in visible indicia on all or nearly all of the elements, that may be reflected in audible indicia in audio communication elements such as cassette tapes or CD's, and that forms the thematic basis of each of the communication elements. Each of the themed communication elements is tied to the others in that together they constitute a series of progressive correspondences, each building on the last and together forming an intriguing and sometimes elaborate invitation to a secret rendezvous with an anonymous admirer.

DESCRIPTION OF THE PREFERRED EMBODIMENT

Figure 1:
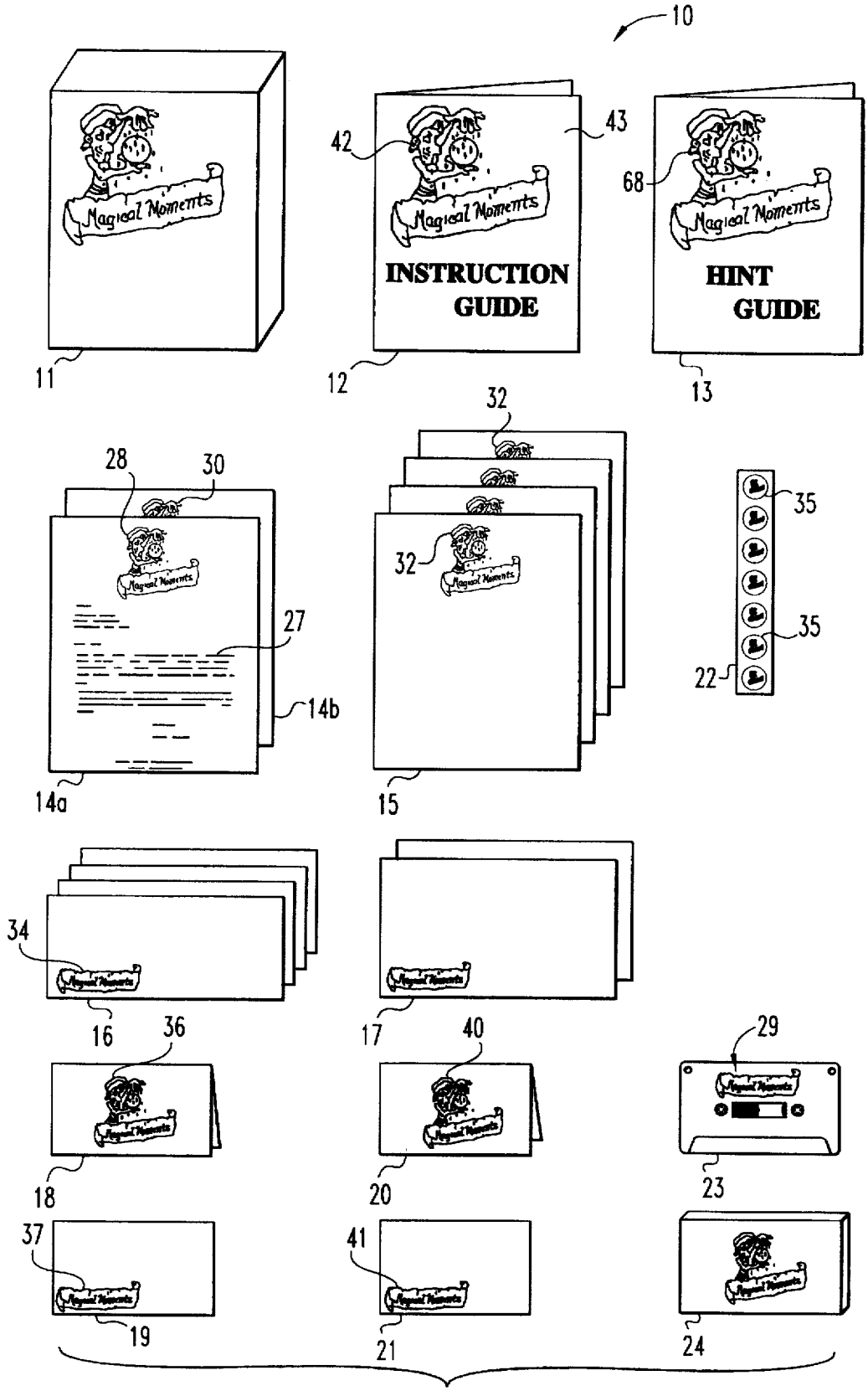
FIG. 1 is a layout view of the elements for the method and apparatus for a secret identity adventure game in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Referring now to FIG. 1, there are shown the elements for an unknown identity adventure game 10 in accordance with the preferred embodiment of the present invention. The elements generally include game box 11, instruction guide 12, hint guide 13, pre-typed letters 14*a* and 14*b*, blank stationery 15, envelopes 16, envelopes 17, invitation 18, envelope 19, thank you card 20, envelope 21, stickers 22, pre-recorded audio cassette tape 23 and box 24. Each element of game 10 is prepared specifically to advance the overall purpose of the game: to provide an alternative new vehicle for social interaction. In some cases, this can be merely a social exercise between friends. In other instances, the game can be played to uniquely and cleverly introduce or enhance the romantic interest between two parties. The present invention achieves this objective with the use of progressive, themed correspondences which embody a pre-defined story that unfolds through preparation and delivery of a series of correspondence elements. In addition, it is preferred that the correspondence elements are sent anonymously. That is, the person or sender sends, delivers or causes to be delivered the various progressive, themed correspondence elements to the target without revealing the sender's identity until the target and sender meet at a specified date, time and place. Each element of game 10 bears visible indicia which is mutually consistent and advances the game's pre-defined story line. The preferred story line centers around a secret admirer scenario. For example, one scenario involves a man, the target, who has a secret admirer in a girl. The girl has found a genie and is granted one wish which she uses to make the genie help her meet the man for a romantic rendezvous. The genie, acting as a third party intermediary, is made to appear as the author of a series of progressive correspondence elements which are delivered to the man.

The first correspondence element is pre-typed letter **14*a* which serves as an introduction to start the game and present the target with just a bit of introduction information. For example, introduction letter 14*a* includes visible indicia 27 in text which is ostensibly from the genie. That is, the letter appears to be authored by the genie in that it is written in the first person, and it is signed by the genie. Signature by the genie is not required, but the tone and content of the letter make it apparent that the letter is from the intermediary and directed to the sender. In similar fashion, the letter "identifies" the target as the recipient. This may be accomplished with a standard salutation to the recipient or in other appropriate ways such as having the target's name on the envelope or by having the target's name used in the body of the audible or visible indicia, as in "Well, here we are again, John . . ." where John is the intended target. Letter 14*a* has the genie identify himself, advising the target that he has a secret admirer and advising the target that the genie will give him some help. Letter 14*a* is also provided with visible indicia 28 (as used herein visible indicia includes, but is not limited to drawings, cartoons, designs, pictures, or text) that is consistent with and advances the game scenario. Here, a cartoon of a genie sprinkling his magic dust over his crystal ball and positioned above a large piece of tattered parchment bearing the words "Magical Moments" appears at the top of letter 14*a*, just above the textual indicia 27. Other "indicia" as applying to the elements of game 10** might also include background designs to the paper, watermarks, the color of the paper or element, or even a simulated aging of the element to make it appear old. For example, aging the paper could make it appear to be ancient parchment. The indicia is intended to enhance the appreciation and spirit of the game scenario and thereby foster a positive feeling in both the sender and the target in playing the game.

The second correspondence element comprises audio cassette tape 23. Upon playing tape 23 the target will hear a voice purporting to be the genie and providing the target with additional information concerning the sender, the intent of the sender and/or what is expected of the target. In the present scenario involving the genie helping his master with her wish, the genie advises the target that the girl found the bottle, was granted a wish and that the wish was that the genie help her with her secret admirer fantasy. The genie further reveals on the tape a few flattering points about the man's secret admirer and advises the man to watch for clues. Like letter 14, tape 23 may bear visible indicia 29 consistent with the game scenario. Tape 23 further includes audible indicia. As used herein, the phrase "audible indicia" refers to sounds that are both audible to and discernible by humans. The audible indicia of tape 23, like the visible indicia of the other elements of game 10, are intended to remain consistent with and enhance the game scenario. In the present genie scenario, the audible indicia of tape 23, when played on an appropriate device such as an a audio cassette player, comprises middle eastern background music, and the voice of the genie in a middle eastern, jewish or other appropriate accent, the origination of which may vary depending on the particular script upon which the tape is based. Other sound effects, as appropriate, may also be included, such as something approximating a genie emerging from his bottle, the genie making himself a drink, etc.

The target has now received a simple introductory letter and then a more substantive correspondence in an audio cassette tape which provides additional information about what the target may now perceive as an intriguing mystery. The second correspondence has thus progressed the game in a number of ways: it constitutes a second correspondence thus confirming to the target the idea that someone is interested in him and is making an effort to make a favorable impression; it provided additional information that built upon or "progressed" from the first correspondence by advising the target about the sender, the intent of the sender (as a secret admirer) and what may be expected of the target; and, it did so in a different medium by using an audio cassette tape.

The third correspondence element comprises a clue which is to be sent to the target along with a fourth correspondence element to be described below. In the present scenario involving tile genie, the clue is provided by the sender herself. As set forth more fully below, the clue could consist of virtually anything, some examples of which include a baby picture, a dinner napkin with the sender's lip impression, a photo of the sender cut in half to reveal only her legs with a note saying "the rest will follow", or a match book of where the sender and target might have once met and with a note written inside. This third correspondence element may have a wide range of effects on the target since it is chosen by the sender and may reveal a little or a lot about the sender in an innocuous or provocative way. The clue, is forwarded to the target along with the fourth correspondence element, the second pre-printed letter **14*b*. Letter 14*b* builds upon the information relayed by the first and second correspondence elements, letter 14*a* and tape 23, and advises the target that the genie is helping him by providing a clue and that he will be setting up a meeting between the sender and the target. Again, the text of the letter is written to appear as if it is authored by the genie, the text having a certain flamboyancy and arrogance consistent with the genie's persona as directed by the game scenario. Letter 14*b* also bears the same visible indicia 30, (of the genie), at the top of letter 14*b* so that the letters 14*a* and 14*b* appear to be created from the same stationery. Likewise, blank stationery 15 also bears the same visible indicia 32, (of the genie), at at the top of each sheet. The purpose of stationery 15, as described herein, is to permit the sender to handprint or write out the text of letters 14a and 14b onto stationery 15 to personalize the first and third correspondence elements, if desired. In the alternative, the sender could use a computer to prepare the letters onto stationery 15**.

The persona, here discussed of the genie, may change from scenario to scenario depending on who or what is portrayed as the third party intermediary. That is, the possibilities for the casting of the third party intermediary are essentially limitless. For example, the part could be cast as a person, imaginary or real, an animal or an animated object.

Game 10 includes four envelopes 16 for sending letters 14a and 14b to the target. Each of envelopes 16 bears visible indicia 34 that is consistent with and enhances the pre-defined game scenario. Two standard letter envelopes 16 are provided for sending each of letters 14a and 14b, and the additional two envelopes are to provide for errors in addressing or to provide for additional correspondences that the sender might prepare and send on her own. Likewise, there are four blank pieces of stationery 15, also to provide for errors in preparing the introductory and clue letter and to provide for additional correspondences that the sender might draft.

Envelopes 17 are slightly larger than envelopes 16, five inches by seven inches, and are provided for sending the clue to the target along with, if desired, the corresponding letter 14b. The second envelope 17 is provided for sending the audio cassette tape 23 and box 24.

Stickers 22 comprise a strip of a number of peel away stickers 35, each sticker 35 bearing visible indicia that is consistent with and enhances the pre-defined game scenario (here, the same cartoon of the genie). Each sticker 35 is intended to be applied over the closed flap of the envelope both to further seal the envelope and to provide the additional scenario-consistent indicia. It is contemplated that extra stickers could be provided and used as desired by the sender at other places on any of the game elements.

The fifth correspondence element comprises an invitation 18 which is a folded card bearing on its front visible indicia 36 that is identical to indicia 28, 30 and 32 of letters 14a and 14b and of stationery 15. Invitation 18 is a folded card which bears on its inside, indicia that is consistent with and enhances the game scenario and that builds upon information provided in previous correspondence elements. That is, the fourth correspondence element, letter 14b, advised the target that he (the genie) would be setting up a meeting between the sender and the target, and the fifth correspondence element embodies that scheduled meeting by providing the target with an invitation to the meeting. The invitation requests the recipient to be at a certain place at a certain date and time and also provides the recipient with additional information such as suggested attire and a clue as to how to recognize the sender. In the present embodiment, the information provided by the invitation is to be filled in by the sender, as appropriate. An appropriately sized envelope 19 is provided for sending invitation 18. Envelope 19 is provided with visible indicia 37 that is identical to indicia 34 of envelopes 16.

A thank you card 20 is also provided to complete the correspondence elements of game 10. The sender may fill out thank you card 20 and send or deliver it to the target after the rendezvous has occurred. An envelope 21 is provided for thank you card 20 and both thank you card 20 and envelope 21 bear scenario-consistent visible indicia, as appropriate.

Figure 2:
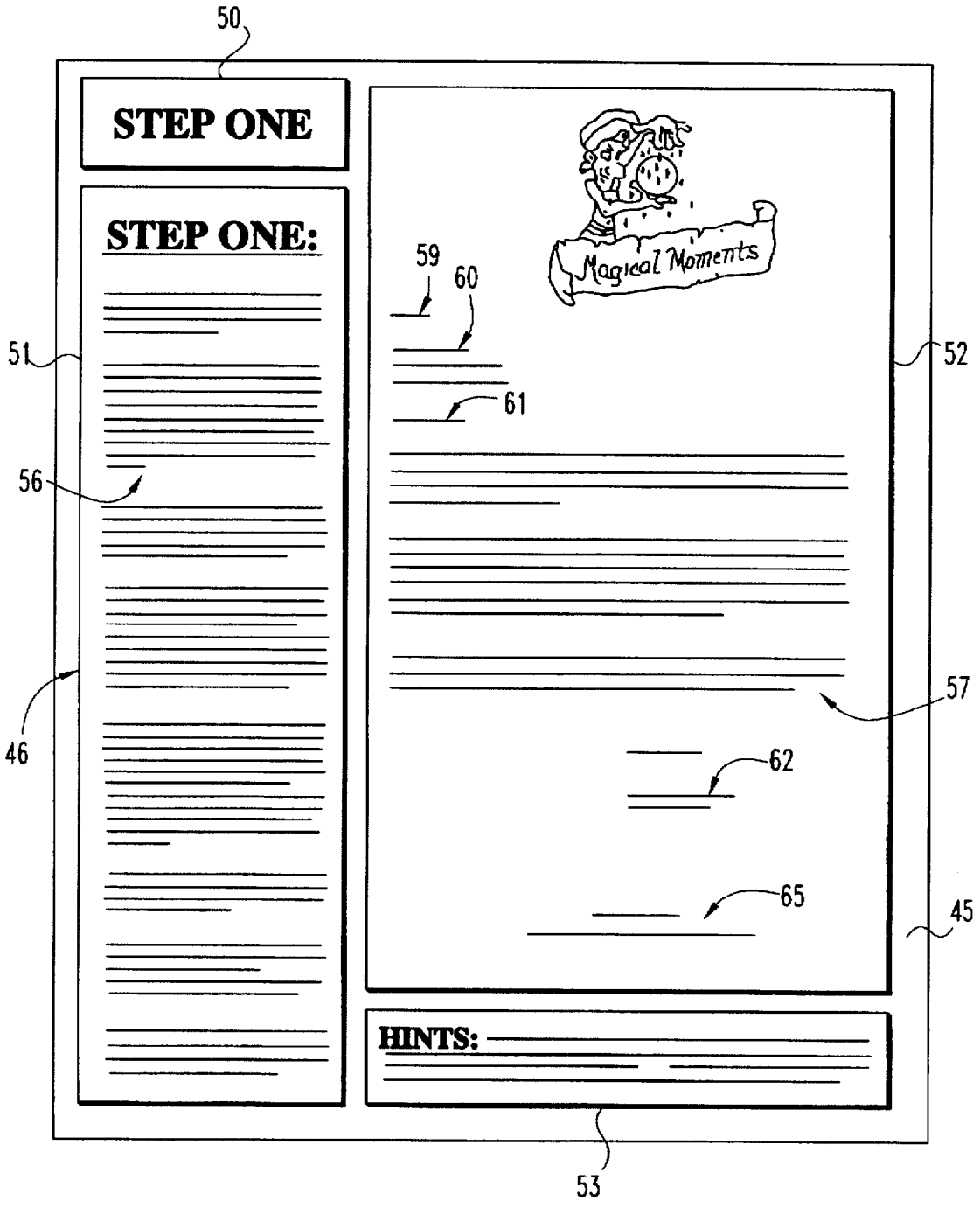
FIG. 2 is a sample layout view of a page of the instruction guide 12 of game 10 of FIG. 1.

The manner for preparing and creating the corresponding elements and other components of game 10 are described in instruction guide 12. Like the other elements of game 10, instruction guide 12 bears visible indicia 42 on its front cover 43 that is consistent with and augments the game scenario. Referring to FIG. 2, there is shown a sample page 45 from within instruction guide 12, page 45 including visible indicia 46 that advises the sender on how to prepare and send each of the correspondence elements of game 10. Visible indicia 46 of page 45 includes but is not limited to, a step marker 50, a step description section 51, a correspondence element representation 52 and a step hint section 53. Step marker 50 indicates which step of the game is being discussed by the adjacent and indicia.

Step description section 51 advises the sender how to prepare and forward the correspondence element. In one embodiment, section 51 of the page dealing with Step One—the introduction letter—includes visible indicia 56 which is text that reads as follows.

Step One

Here we go! First review each step and the pro-typed letters cleverly designed to enchant your beau.

Now it's time to send your first message. Send the pre-typed letter.

Or should you decide to make it more personal, handwrite or type your letter on the extra stationary provided. The example to the right will serve as an outline. In order to maintain your romantic strategy, we recommend that you copy/type all three letters at the same time.

Now handwrite the address on the envelope and pop it into the mail. For mega laughs send your letters to his business address, his co-workers will love it!

Special touches like handwriting the addresses and misting the envelopes with perfume will separate your letter from the rest of his mail. The perfume not only makes a bigger impact, it entrances yet another of his senses.

Enticing him is our game, so remember to send one correspondence each day!

Don't forget to hand sign the letters from "Ernie D. Genie."

Correspondence element representation 52 of the Step One page appears as the letter referred to in step description section 51 and relays to the sender both the text and the format that the sender is advised to use if she decides to handwrite or type the introductory letter 14a onto a piece of the stationery 15 provided. The textual indicia 57 of correspondence element representation 52 is substantially identical to the textual indicia 27 of introductory letter 14a except that indicia 57 includes indications to fill in the date (at 59), the target's name and address (at 60), the personalized salutation (at 61), and the Genie's signature (at 62). That is, pre-printed letter 14a does not carry with its textual indicia those elements—the date, target's name and address, personalized salutation, or Genie's signature—and textual indicia 57 advises the sender to fill those in as she is transcribing the body of the letter onto stationary element 15. At the bottom of correspondence element 52, there appears additional visible indicia 65 representing the address of the sender, Ernie D. Genie. In the present embodiment, that indicia is, "1 wish 4-U, Star Dust, Desert XXXXO."

Step hint section 53 of the Step One page of the present embodiment provides the sender with a hint as follows.

Hints: Should you decide to type the letters, print the letter out on a clean white sheet to make sure the letter lines up correctly. Then photocopy it on to the letterhead. We have supplied a few extra sheets for your convenience.

The next page (not shown) of instruction guide 12, relating to Step Two—the audio cassette—is essentially identical to the Step One page 45 of FIG. 2, except as follows. Step marker 50 reads: Step Two, Audio Cassette".

The step description section 51 of the Step Two page (not shown) of instruction guide 12 reads as follows:

Step Two

Now that you've aroused his interest it's time to capture his curiosity!

In this humorous pre-recorded tape "Ernie D. Genie" sets the stage for fun and suspense.

Laugh along with the tape. However, remember to rewind it to the beginning prior to mailing. The script to the right is for giggles later.

As you're stimulating another one of his senses, he'll be carefully replaying the tape trying to discover who his secret admirer could be.

Not only will he be flattered with your ingenuity, you'll be creating a positive image for you and your Mysterious Romantic Rendezvous!

Simply place the tape into the themed box. Then slip it into the 5×7 envelope and send it on it's way.

He should receive this the day after the first letter.

Correspondence element representation 52 of the Step Two page (not shown) of instruction guide 12 contains the script of audio cassette tape 23 along with staging instructions such as reference to background music and effects. This permits the user to more fully appreciate the audio track contained on cassette tape 23. In the present embodiment, there is no step hint section 53 on the Step Two page (not shown) of instruction guide 12.

The next page (not shown) of instruction guide 12, relating to Step Three—the clue—is essentially identical to the Step One page 45 of FIG. 2. except as follows. Step marker 50 reads: "Step Three". Step description section 51 of the Step Three page (not shown) reads as follows:

Step Three

The clue! This is where things get really exciting! Sign the pro-typed letter from "Ernie D. Genie" or copy the letter to the right, then enclose your alluring clue.

Some examples might include

A baby picture  A dinner napkin with your lip impression  Draw a heart with your perfume in the middle, accompany it with a note, saying "do you remember this scent?"  A matchbook of where you originally met, with a note written inside  A cut out heart with the title of a shared song or favorite place  A lock of hair  A photo of yourself cut in half to reveal only your legs, with a note saying "The rest will follow"**

If you're already in a relationship

Send a clue so he will think you are his secret admirer, but if he asks, playfully keep him guessing.

Other suggestions could include

A candle with a clever message: "You lite my fire" A feather with the message: "You tickle me" A small box of chocolates "your so sweet" or "I crave sweet things."

Your clue should be consistent with the impression you want to create. Poems convey an entirely different message than lingerie.

Place the clue and letter in one of the 5"×7" envelopes and mail it. Remember to be creative! He'll go crazy trying to figure out your secret identity!

He should receive this the day after the tape.

Correspondence element representation 52 of the Step Three page (not shown) contains the text of the pre-printed letter 14*b*, along with reference for the sender to add the date 59, the name and address 60, the target's salutation 61 and the signature 62, as discussed for the Step One page 45.

Step hint section 53 of the Step Three page (not shown) of the present embodiment provides the sender with a hint as follows.

Hints: It's time to start planning. Review Susan's Dating Tips. This booklet gives you lots of hints planning and executing your Romantic Rendezvous The next page (not shown) of instruction guide 12 is essentially identical to the Step One page 45. of FIG- 2. except as follows. Step marker 50 reads: "Step Four".

Step description section 51 of the Step Four page (not shown) reads as follows:

Step Four

Here it is—the big finale! Fill in your details on the invitation. It's a good idea to make a copy and mark your calendar.

The following are suggestions where to meet your man on your romantic rendezvous.

Your favorite restaurant, museum or music festival. You might even want to consider an event with assigned seating. Buy two tickets and leave one at the ticket counter in his name. It's a good idea to meet in a public place with some activity around. Be careful it's not too loud. You want to be able to hear your beau as well as keep him captivated.

Remember to allow your dream date enough time to clear his schedule. If you don't know your date that well, we suggest that you meet on a Wednesday or Thursday. There will be less chance of a conflict with his schedule.

Also include a description of what you will be wearing. Clue him in! For example: Look for the Lady in Red. Mail this invitation the day after sending Step Three.

Correspondence element representation 52 of the Step Four page (not shown) of instruction guide 12 is a pictorial representation of the inside of invitation 18 and reads as follows: "Your are Invited to a Mysterious Romantic Rendezvous." The invitation 18 also provides tagged lines to fill in "Where", "Date", "Time", "Attire", and "Clue".

Step hint section 53 of the Step Four (not shown) reads as follows:

Hints: This is the big, big finish so . . . send this invitation with some balloons. Have a friend call and confirm to determine if your beau is available or if he needs to reschedule. It would be fun if your friend would pretend to be "Ernie". Now, review Susan's Dating Tips check list to make sure you've thought of everything!

Hint guide 13 is also provided as an element of game 10 and as referred to in the instruction guide 12, it provides additional dating tips concerning a variety of instructions on the art of dating. The tips are directed but not limited to attire, make-up, conversation, etiquette, food selection, and pre-date and post-date conversation and behavior. The contents of hint guide 13 may vary depending on the particular scenario. Hint guide 13 includes visible indicia 68 on at least its cover that is consistent with and enhances the game scenario.

While each element of the present element has been described to contain some visible indicia consistent with and contributing to the overall game scenario, it is contemplated that some elements may lack any particular visible indicia where appropriate and not inconsistent with the pre-defined scenario. Also, the story lines may vary from scenario to scenario; however, each scenario is contemplated to include an intermediate figure who is the apparent author of the correspondence elements and who is not either the target or the person who is administering the game.

The method presented herein for playing game 10 is contemplated as being unique each time the game is played in that each different person who administers the game (the sender) will provide his or her own personal touch transcribing the letter; will each time provide a different clue; and, will select a different meeting place. Moreover, the provision of stationery 15 permits the sender to modify any of the letters as desired, or permits the sender to deviate further from the described method by sending additional notes or clues to the target in addition to the five themed correspondence elements discussed herein.

The preferred embodiment of the present invention contemplates using the five elements described herein from introduction to invitation. Using any fewer of the described elements may not realize the full effect of the themed progressive correspondence system. That is, each correspondence element lays some ground work for the next correspondence or event. A connection is thereby created among each of the correspondence elements and the game is permitted to flow throughout its course with its target remaining interested and intrigued to such extent that when the invitation for the final rendezvous arrives, the target's interest is at a peak and the target will actually show up for the rendezvous. While using as few as two of the recited five correspondence elements may achieve the desired result, it is contemplated that the introduction correspondence element, the audio cassette tape correspondence element, and the invitation correspondence element are the preferred minimum, and the preferred embodiment includes all five elements—the introduction correspondence element, the audio correspondence element, the clue correspondence element, the clue element and the invitation correspondence element. Also, additional correspondence elements are contemplated within the scope of the present invention, but is believed that additional correspondence elements could adversely extend the time period from initial introduction to ultimate meeting.

While the present invention describes sending the correspondence element to the target in the order of introduction, audio correspondence, clue correspondence and clue, and invitation correspondence, it is contemplated that this order of delivery could be varied with satisfactory effect. For example, the invitation could be delivered third and, between the delivery of the invitation and the scheduled rendezvous, a clue correspondence and clue could be delivered to further enhance that anticipation of the ultimate meeting. Alternatively, more than one clue element could be delivered to the target. For example, a clue could be sent before the invitation and another clue or clues could be sent to the target after the invitation, again further heightening the anticipation of the ultimate meeting. Further embodiments contemplate the same clue divided into multiple pieces, each piece being delivered intermittently along with or between the other correspondence elements so that, before the rendezvous or at the rendezvous, the final clue piece is received by the target with a corresponding and hopefully pleasurable realization of who the sender is.

An alternative embodiment includes one or more correspondence elements that direct the target to seek out clues to the identity of the sender as opposed to having the clues delivered to him.

While the scenario presented herein is directed to a woman being the secret admirer for a man, other embodiments contemplate two or more people in any gender combination as comprising the sender and target.

The preferred embodiment contemplates a truly secret identity scenario, that is, that the target does not know the sender. Other embodiments contemplate modified, pretend secret identity scenarios where the target knows the person who is the sender, but does not know that that person is the sender, and contemplates that the target knows both the person who is the sender and that that person is the sender.

A primary benefit to this invention is that the sender can control her own destiny. In the preferred embodiment, she can initiate the themed progressive correspondence process without risk. If the target fails to show up at the appointed time, it is of little consequence because her identity was not revealed in the correspondences. Her ability to control her destiny is further enhanced in that she can choose the target and set up and plan the rendezvous without revealing her identity. The same type of mystique and excitement that is created when the sender is totally anonymous is also created in the alternative embodiments where the sender is known by the target.

Another embodiment includes the second correspondence element, tape 23, initially being blank or including both a blank and a pre-recorded version. The sender could then record the message or have it recorded onto the blank tape for delivery to the target. In this way, the sender may add to or modify the message, for example, to build on the other correspondence elements.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An adventure game, comprising:

a first themed communication element having audible or visible indicia introducing an intermediary, identifying the intermediary as an author of said first themed communication element, identifying that said first themed communication element is directed to a target, and explaining that a person is interested in the target;

a second themed communication element having audible or visible indicia identifying the intermediary as an author of said second themed communication element, identifying the target as the recipient of said second element, and expressing additional information concerning at least one of the person, the intent of the person, and what is expected of the target;

a third communication element directed to the target and including audible or visible indicia inviting the target to be at a certain place at a certain time;

an instruction guide including audible or visible indicia instructing the person to send said first themed communication element to the target first, to send said second themed communication element to the target after said first themed communication element and to send said third communication element to the target after said second themed communication element; and, wherein each of said communication elements is a part of a pre-defined scenario having a particular theme with at least said first and second communication elements having additional audible or visible indicia consistent with said theme.

2. The adventure game of claim 1 wherein said second themed communication element is an audio-cassette tape with audible indicia consistent with said theme.

3. The adventure game of claim 2 wherein the identity of the person is not revealed to the target in any of said communication elements.

4. The adventure game of claim 2 wherein the intermediary is a fictitious entity consistent with said theme.

5. The adventure game of claim 2 wherein said first themed communication element is a pre-printed letter on stationery bearing visible indicia consistent with said theme.

6. The adventure game of claim 5 further including additional stationery bearing visible indicia consistent with said theme, and wherein said instruction guide includes text instructing the person in the alternative to copy text of said first themed communication element onto said additional stationary and to deliver said additional stationary with the copied text to the target instead of said first themed communication element.

7. The adventure game of claim 6 further including a fourth themed communication element having text comprising a clue or referring to a clue as to the identity of the person, and wherein said instruction guide includes text directing the person to send said fourth communication element to the target after said second themed communication element.

8. The adventure game of claim 7 wherein said instruction guide includes text directing the person to provide a clue object and to send said fourth communication element and said clue object to the target after sending said second communication element.

9. The adventure game of claim 7 further including envelopes bearing visible indicia consistent with said theme.

10. The adventure game of claim 9 further including stickers for sealing said envelopes and bearing visible indicia consistent with said theme.

11. The adventure game of claim 7 wherein said third communication element is an invitation inviting the target to meet the person at a place and time.

12. The adventure game of claim 7 further including a hint guide including text providing the person with additional information concerning actions the person could take to enliven said correspondences and concerning the ultimate meeting with the target.

13. A method for playing an adventure game, comprising the steps of:

providing a kit including:

a first themed communication element having audible or visible indicia introducing an intermediary, identifying the intermediary as an author of said first themed communication element, identifying that said first themed communication element is directed to a target, and explaining that a person is interested in the target;

a second themed communication element having audible or visible indicia identifying the intermediary as an author of said second themed communication element, identifying the target as the recipient of said second element, and expressing additional information concerning at least one of the person, the intent of the person, and what is expected of the target;

a third communication element directed to the target and including audible or visible indicia inviting the target to be at a certain place at a certain time;

an instruction guide including audible or visible indicia instructing the person to send said first themed communication element to the target first, to send said second themed communication element to the target after said first themed communication element and to send said third communication element to the target after said second themed communication element;

wherein each of said communication elements is a part of a pre-defined scenario having a particular theme with at least said first and second communication elements having additional audible or visible indicia consistent with said theme;

delivering said first themed communication to the target;

delivering said second themed communication to the target after delivering said first themed communication;

delivering said third communication to the target after delivering said second themed communication; and, meeting the target at the place and time identified in said third communication.

14. The method for playing an adventure game of claim 13 wherein said providing step includes said second themed communication element being an audio-cassette tape having audible indicia consistent with said theme.

15. The method for playing an adventure game of claim 14 wherein said providing step includes the identity of the person not being revealed to the target in any of said communication elements.

16. The method for playing an adventure game of claim 14 wherein said providing step includes the intermediary being a fictitious entity consistent with said theme.

17. The method for playing an adventure game of claim 14 wherein said providing step includes said first themed communication element being a pre-printed letter on stationery bearing visible indicia consistent with said theme.

18. The method for playing an adventure game of claim 17 wherein said providing step includes said kit further including additional stationery bearing visible indicia consistent with said theme, and wherein said method further includes copying text of said first themed communication element onto said additional stationary and delivering said additional stationary with the copied text to the target instead of said first themed communication element.

19. The method for playing an adventure game of claim 17 wherein said providing step includes said kit further including a fourth communication element having text comprising a clue or referring to a clue as to the identity of the person, and wherein said method further includes delivering said fourth communication element to the target after said second themed communication element.

20. The method for playing an adventure game of claim 19 further including providing a clue object and delivering said clue object with said fourth communication element to the target after delivering said second communication element.

21. The method for playing an adventure game of claim 17 wherein said providing step includes said kit further including envelopes visible bearing indicia consistent with said theme.

22. The method for playing an adventure game of claim 21 wherein said providing step includes said kit further including stickers for sealing said envelopes and bearing visible indicia consistent with said theme.

23. The method for playing an adventure game of claim 17 wherein said providing step includes said kit further including a hint guide including text providing the person with additional information concerning actions the person could take to enliven said correspondences and concerning the ultimate meeting with the target.

24. The method for playing an adventure game of claim 14 wherein said providing step includes said third communication element being an invitation inviting the target to meet the person at a place and time.

25. An adventure game, comprising:

a first themed communication element having audible or visible indicia introducing an intermediary, identifying the intermediary as an author of said first themed communication element, identifying that said first themed communication element is directed to a target, and explaining that a person is interested in the target;

a second themed communication element having audible or visible indicia comprising a clue or referring to a clue as to the identity of the person;

a third communication element directed to the target and including audible or visible indicia inviting the target to be at a certain place at a certain time;

an instruction guide including audible or visible indicia instructing the person to send said first themed communication element to the target first, to send said second themed communication element to the target after said first themed communication element and to send said third communication element to the target after said second themed communication element; and, wherein each of said communication elements is a part of a pre-defined scenario having a particular theme with at least said first and second communication elements having additional audible or visible indicia consistent with said theme.

26. The adventure game of claim 25 wherein said instruction guide includes text directing the person to provide a clue object and to send said clue object to the target along with said second communication element.

27. The adventure game of claim 26 wherein said instruction guide includes text directing the person to provide more than one clue object and to send said clue objects separately to the target.

28. An adventure game, comprising:

a first themed communication element having audible indicia introducing an intermediary, identifying the intermediary as an author of said first themed communication element, identifying that first themed communication element is directed to a target, and explaining that a person is interested in a target;

a second themed communication element directed to the target and including audible or visible indicia inviting the target to be at a certain place at a certain time;

an instruction guide including audible or visible indicia instructing the person to send said first themed communication element to the target first and to send said second themed communication element to the target after said first themed communication element; and wherein each of said communication elements is part of a pre-defined scenario having a particular theme with said first and second communication elements having additional audible or visible indicia consistent with said theme.

29. The adventure game of claim 28 wherein said first themed communication element is an audio-cassette tape.

* * * * *